US011345496B2

(12) United States Patent
Kurosaki

(10) Patent No.: US 11,345,496 B2
(45) Date of Patent: May 31, 2022

(54) PACKED BODY PRODUCTION METHOD

(71) Applicant: CORELEX SHIN-EI CO., LTD., Fuji (JP)

(72) Inventor: Satoshi Kurosaki, Fuji (JP)

(73) Assignee: CORELEX SHIN-EI CO., LTD., Fuji (JP)

( * ) Notice: Subject to any disclaimer, the term of this patent is extended or adjusted under 35 U.S.C. 154(b) by 58 days.

(21) Appl. No.: 17/047,762

(22) PCT Filed: Feb. 21, 2019

(86) PCT No.: PCT/JP2019/006505
§ 371 (c)(1),
(2) Date: Oct. 15, 2020

(87) PCT Pub. No.: WO2019/239637
PCT Pub. Date: Dec. 19, 2019

(65) Prior Publication Data

US 2021/0163162 A1 Jun. 3, 2021

(30) Foreign Application Priority Data

Jun. 14, 2018 (JP) ..... 2018-113348

(51) Int. Cl.
*B65B 11/58* (2006.01)
*B65B 11/02* (2006.01)
(Continued)

(52) U.S. Cl.
CPC ..... *B65B 11/585* (2013.01); *B65B 11/025* (2013.01); *B65B 35/50* (2013.01); *B65D 71/0088* (2013.01); *B65D 71/06* (2013.01)

(58) Field of Classification Search
USPC ..... 53/399
See application file for complete search history.

(56) References Cited

U.S. PATENT DOCUMENTS 3,788,462 A 1/1974 Meineer
4,060,957 A * 12/1977 Birkenfeld ..... B65B 53/02 53/442
(Continued)

FOREIGN PATENT DOCUMENTS

DE 1611865 A 9/1971
DE 4130254 C1 9/1992
(Continued)

OTHER PUBLICATIONS

International search report for PCT/JP2019/006505 dated Apr. 2, 2019.

*Primary Examiner* — Chinyere J Rushing-Tucker
(74) *Attorney, Agent, or Firm* — Sughrue Mion, PLLC

(57) ABSTRACT

There is provided a method of producing a packed body that does not fall off and collapse during transportation and does not cause damage to cartons and paper material locally and around which a packing film can be wound easily. A packed body production method includes a first step in which a layered body is formed by stacking cartons containing toilet paper rolls and in which an insertion section into which a fork unit of a forklift is inserted is formed at a predetermined position in the layered body, a second step in which a first packing film is wound spirally around at least side surfaces of the layered body, and a third step in which a second packing film is wound around the layered body so as to close an opening of the insertion section.

2 Claims, 5 Drawing Sheets

(51) Int. Cl.

| | |
|---|---|
| ***B65B 35/50*** | (2006.01) |
| ***B65D 71/00*** | (2006.01) |
| ***B65D 71/06*** | (2006.01) |

(56) References Cited

U.S. PATENT DOCUMENTS

| | | | | |
|---|---|---|---|---|
| 4,077,179 | A | 3/1978 | Lancaster et al. | |
| 4,724,652 | A * | 2/1988 | Birkenfeld | B65B 53/02 53/442 |
| 4,845,918 | A * | 7/1989 | Klupfel | B65B 53/02 53/170 |
| 5,195,295 | A * | 3/1993 | Kurosaki | B65D 71/0088 53/399 |
| 6,775,956 | B1 * | 8/2004 | Lacey | B65B 11/585 53/399 |
| 2004/0123562 | A1 | 7/2004 | Matsumoto et al. | |
| 2015/0307290 | A1 * | 10/2015 | Köhn | B65G 57/03 206/598 |
| 2018/0282003 | A1 * | 10/2018 | Kurosaki | B65B 13/181 |

FOREIGN PATENT DOCUMENTS

| | | | |
|---|---|---|---|
| EP | 2 248 722 | A1 | 11/2010 |
| JP | 53-11690 | A | 2/1978 |
| JP | 4-189764 | A | 7/1992 |
| JP | 2596855 | B2 | 4/1997 |
| JP | 2001-278208 | A | 10/2001 |
| JP | 2017-165479 | A | 9/2017 |

* cited by examiner

PACKED BODY PRODUCTION METHOD

CROSS-REFERENCE TO RELATED APPLICATIONS

This application is a National Stage of International Application No. PCT/JP2019/006505 filed Feb. 21, 2019, which claims priority under U.S.C. § 119(a) to Japanese Patent Application No. 2018-113348 filed on Jun. 14, 2018.

TECHNICAL FIELD

The present invention relates to a method of producing a packed body that is formed by packing a layered body.

BACKGROUND ART

A roll of toilet paper or a pack of paper tissues (hereinafter referred to as "toilet paper roll and the like") are lightweight. Accordingly, multiple pieces are normally packed together for transportation.

For example, multiple toilet paper rolls and the like are accommodated in a carton made of a film. The film-made cartons are stacked in layers so as to form a layered body. The layered body produced is formed into a packed body by winding a cord or a band for such purpose therearound. The packed body is mounted on a pallet and transported by a forklift.

Here, a technique that enables transportation of a packed body without using a pallet has been disclosed (for example, see PTL 1). In this technique, a recess-like insertion section is provided in the packed body, and the fork unit of a forklift is inserted in the insertion section for transportation.

In the technique disclosed in PTL 1, a layered body is formed by stacking multiple cardboard boxes that contain toilet paper rolls and the like. Subsequently, recesses are formed on respective side surfaces of the layered body, and multiple bands are wound around the outer periphery of the layered body, which thereby prevents cardboard boxes stacked in multiple layers from collapsing.

CITATION LIST

Patent Literature

[PTL 1] Japanese Patent No. 2596855

SUMMARY OF INVENTION

Technical Problem

The technique disclosed in PTL 1 enables transportation of a packed body without using a pallet. In order to prevent the packed body from collapsing during transportation of the packed body by using a forklift, it is necessary to wind a band around the layered body.

However, this technique is such that a packed body is packed simply by using multiple bands. Accordingly, when the fork unit inserted in the recesses is slid sideways during transportation, for example, the fork unit may hit the band several times. This may break the band and cause the cardboard boxes to fall off the fork unit and collapse. The packed body is not stable.

On the other hand, if the packed body is packed by winding the band therearound more strongly so as to prevent the packed body from collapsing, the cardboard boxes or the toilet paper rolls and the like contained therein may deform.

That is, the cardboard boxes or the toilet paper rolls and the like that are in contact with the band may be damaged locally.

Accordingly, an object of the present invention is to provide a method of producing a packed body that does not fall off and collapse during transportation, that does not cause damage to cartons or toilet paper rolls and the like locally, and around which a packing film can be wound easily.

Solution to Problem

A packed body production method according to the present invention for producing a packed body by packing a layered body of cartons containing paper material is characterized by that the method includes a first step in which the layered body is formed by stacking the cartons containing paper material and in which an insertion section into which a fork unit of a forklift is inserted is formed at a predetermined position in the layered body, a second step in which a first packing film is wound spirally around at least side surfaces of the layered body, and a third step in which a second packing film is wound around the layered body so as to close an opening of the insertion section. In the first step, the cartons are stacked in such a manner that the insertion section is formed at such a position as to enable the layered body to be lifted using the fork unit of the forklift. In addition, in the second step, the first packing film is wound around the layered body so as to retain the layered body entirely. Moreover, in the third step, the layered body is laid sideways and the second packing film is subsequently wound around the layered body so as to generate such a fixation strength that the layered body does not collapse when the layered body is lifted using the fork unit of the forklift.

The packed body production method according to the present invention is further characterized by that in the first step, the layered body includes a lower layer, an intermediate layer disposed on the lower layer, and an upper layer disposed on the intermediate layer. In addition, in the first step, the insertion sections are formed as recesses at opposite side surfaces of the layered body by disposing the intermediate layer having a width smaller than a width of the lower layer and a width of the upper layer. Moreover, in the third step, the second packing film is wound around the layered body in such a manner that a top surface of the upper layer, the insertion sections, and a bottom surface of the lower layer are wrapped with the second packing film.

In addition, the packed body production method according to the present invention is further characterized by that in the third step, the layered body is placed on the second packing film at a position near one longitudinal end thereof, and the second packing film is wound around the layered body by bringing the other longitudinal end of the second packing film toward the top surface of the upper layer.

Moreover, the packed body production method according to the present invention is further characterized by that in the third step, the layered body is placed on the second packing film at a longitudinal center thereof, and the second packing film is wound around the layered body by bringing both longitudinal ends of the second packing film toward the top surface of the upper layer.

Advantageous Effects of Invention

According to the packed body production method of the present invention, a packed body in which the entire openings of the insertion section are covered with the packing film is produced. An advantageous effect is that even if the fork unit inserted in the insertion section is slid during transportation and the fork unit thereby comes into contact with the packing film wound around the openings of the insertion section, the packing film functions as protection walls and thereby prevents the packed body from falling off and collapsing.

In addition, according to the packed body producing method of the present invention, the entire layered body is wrapped around the packing film. This eliminates damage locally occurring to the cartons containing toilet paper rolls and the like or occurring to the toilet paper rolls and the like themselves. In addition, winding the packing film does not require delicate adjustment, which can make it easier to wind the packing film around the layered body.

BRIEF DESCRIPTION OF DRAWINGS

FIG. 3(*a*) is a perspective view illustrating a state in which a first packing film is spirally wound around a layered body. FIG. 3(*b*) is a view for explanation of a process in which a second packing film is wound around the layered body while the layered body is laid sideways. FIG. 3(*c*) is a view for explanation of a process in which the second packing film is wound around the layered body while the layered body stands upright.

FIG. 4(*a*) is a view illustrating a state in which the layered body is placed on the second packing film. FIG. 4(*b*) is a view for explanation of a process in which the second packing film is wound around the layered body.

FIG. 5(*a*) is a view illustrating a state in which the layered body is placed on the second packing film. FIG. 5(*b*) is a view for explanation of a process in which the second packing film is wound around the layered body.

FIG. 6(*a*) is a perspective view illustrating a state in which the first packing film is spirally wound around the layered body. FIG. 6(*b*) is a view for explanation of a process in which the second packing film is wound around the layered body while the layered body stands upright.

DESCRIPTION OF EMBODIMENTS

First Embodiment

Figure 1:
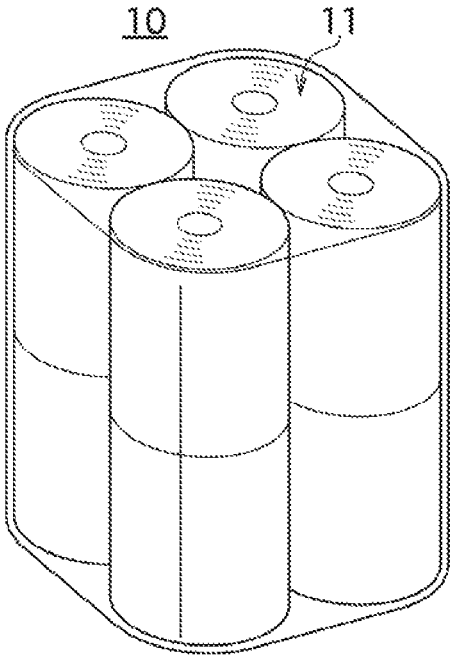
FIG. 1 is a perspective view illustrating a carton according to a first embodiment of the present invention.
Figure 2:
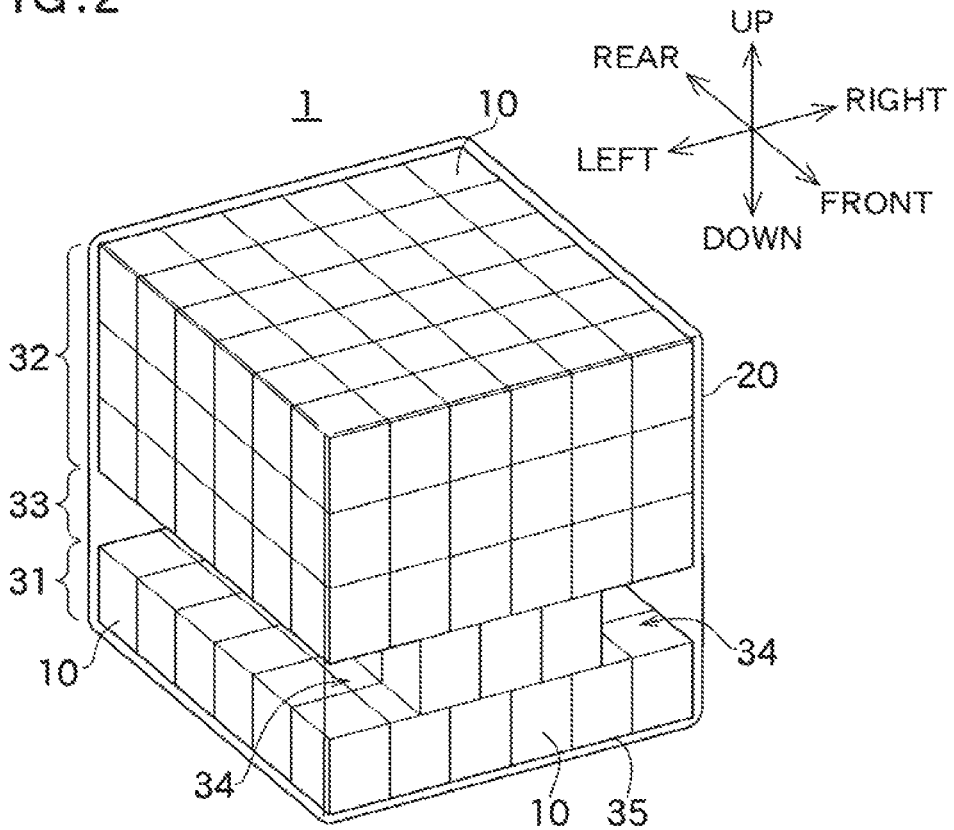
FIG. 2 is a perspective view illustrating a packed body according to the first embodiment of the present invention.

An example of method of producing a packed body according to the present invention will be described with reference to the drawings. FIG. 1 is a perspective view illustrating a state in which toilet paper rolls are accommodated in a carton. FIG. 2 is a perspective view illustrating the packed body formed by stacking multiple cartons.

Note that the present invention is not limited to the embodiments described herein but may have other appropriately modified configurations within the scope of the claims. Unless otherwise stated, the top and the bottom of the packed body are positioned in the vertical direction of the packed body as illustrated in FIG. 2. Similarly, the front and the rear of the packed body are positioned in the depth direction thereof, and the right and the left of the packed body are positioned in the lateral direction thereof.

So-called extra length toilet paper rolls are manufactured so as to be suitable for emergency stocks. Each roll has a roll diameter specified in accordance with Japan Industrial Standards (JIS) and is made by winding a long and thin strip of paper having a length of 100 meters or more. The extra length toilet paper roll, which is formed stiffly by winding a thin strip of paper tightly, has such a hardness that the roll does not deform easily under external pressure.

Since the extra length toilet paper rolls are not easily crushed, it is not necessary to use a solid cardboard box when large quantity of rolls are packed.

In the present embodiment, as illustrated in FIG. 1, multiple extra length toilet paper rolls 11 are accommodated in a light weight carton 10 made of a resin film. Multiple cartons 10 are subsequently stacked to form a layered body as illustrated in FIG. 2. The entire layered body is wrapped with a packing film 20, thereby forming a packed body 1. Now, the method of producing a packed body according to the present invention will be described more specifically.

[Packed Body 1]

The packed body 1 is a layered body wrapped entirely with the packing film 20 that is a stretch film. The layered body is formed by stacking a predetermined number of cartons 10. The packed body 1 is produced by forming a lower layer 31, a middle layer 33, and an upper layer 32 sequentially, and each layer is formed by arranging a predetermined number of cartons 10 without gaps provided therebetween.

Two insertion sections (recessed spaces) 34 are formed respectively on the right and the left of the middle layer 33. The fork unit of a forklift (not illustrated) is inserted and stay in the insertion sections 34. The packed body 1 is transported by a forklift while the fork unit is in the insertion sections 34.

[Lower Layer 31]

The lower layer 31 is the lowermost-level layer of the layered body. The lower layer 31 is formed by arranging a predetermined number of the cartons 10 in such a manner that the width of the lower layer 31 (in the right-left direction) is greater than the width of the later-described middle layer 33 and is similar to the width of the later-described upper layer when the layered body is viewed from in front.

The lower layer 31 is formed by stacking a predetermined number of the cartons 10 in such a manner that the insertion sections 34 are formed at a height at which the fork unit of a forklift can enter the insertion sections 34. Note that as illustrated in FIG. 2, the lower layer 31 may be formed by arranging the cartons 10 in a single layer in the right-left direction instead of stacking the cartons 10 in multiple layers.

[Middle Layer 33]

The middle layer 33 is an mid-level layer formed on the lower layer 31. The middle layer 33 is a layer in which the insertion sections 34 are formed in similar sizes and disposed in the right-left direction of the middle layer 33 when the layered body is viewed from in front. In other words, the middle layer 33 are formed at a central region of the lower layer 31 in such a manner that the insertion sections 34 are formed in bilateral symmetry when the layered body is viewed from in front.

[Upper Layer 32]

The upper layer 32 is an upper-level layer formed on the middle layer 33. The upper layer 32 is formed such that a number of the cartons 10, the number of which is the same as that of the lower layer 31, are arranged in the right-left and the front-rear directions and the arranged cartons 10 are stacked multiply.

Note that the number of the cartons 10 arranged in the front-rear direction of the layered body is the same as that of the lower layer 31, the middle layer 33, or the upper layer 32.

[Carton 10]

A carton 10 is made of a resin film. However, the material is not limited to the resin film insofar as it is lightweight and durable. For example, two toilet paper rolls 11 are arranged in each of two rows, and two sets of the two rows are stacked in two layers in the carton 10. In other words, a total of eight rolls of toilet paper are accommodated in the carton 10. The rolls of toilet paper are otherwise referred to as a "paper material". In the following description, a carton 10 that contains toilet paper rolls may be also referred to as the "carton 10".

The carton 10 is made of a thin and lightweight resin film, which can eliminate the use of a thick cardboard box having a considerable weight. This can reduce the outer dimensions of the packed body 1 and also enables the packed body 1 to be formed into various shapes.

[Toilet Paper Roll 11]

A toilet paper roll 11 is, for example, a coreless paper roll manufactured by winding a strip of paper into a roll without using a cardboard core. More specifically, the toilet paper roll 11 is an extra length toilet paper roll manufactured by winding a thin strip of paper, which is longer than a typical toilet paper strip, into a roll having a diameter in accordance with JIS while a large tension is applied to the strip of paper in manufacturing.

[Method of Producing Packed Body]

Figure 3A:
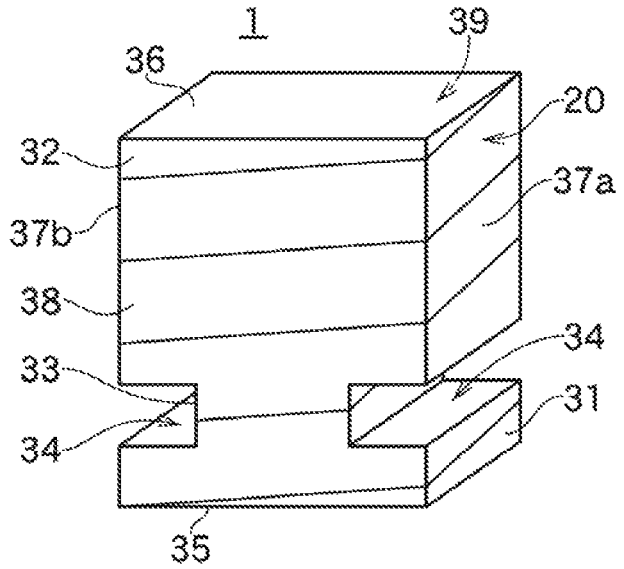
FIGS. 3(*a*), 3(*b*), 3(*c*) are views for explanation of production method of the packed body according to the first embodiment of the present invention.
Figure 3B:
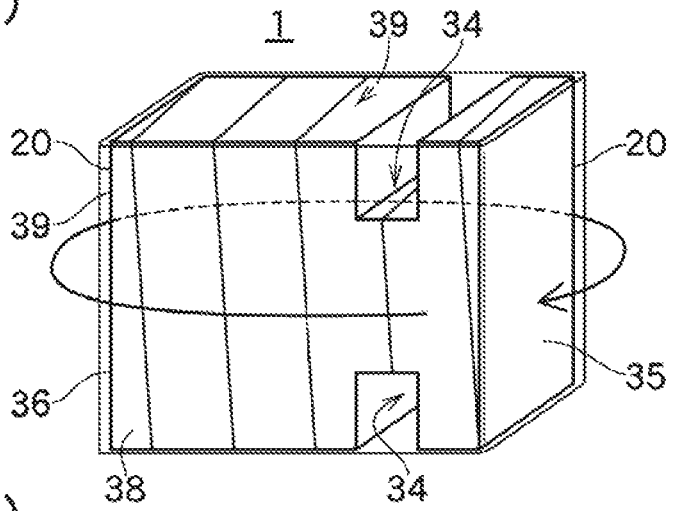
Figure 3C:
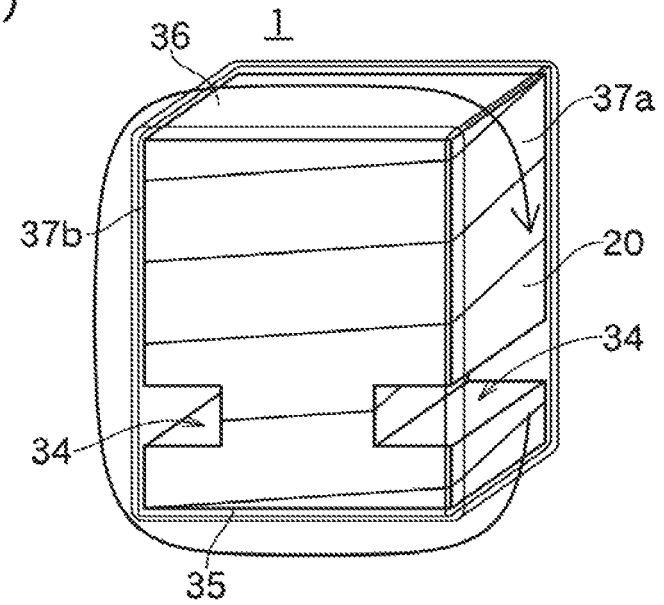

FIGS. 3(*a*). 3(*b*), 3(*c*) are diagrams illustrating a process of stacking multiple cartons 10 to form a layered body and a subsequent process of winding the packing film 20 around the layered body.

In producing the packed body 1, the lower layer 31 is formed first to a predetermined height by arranging multiple cartons 10 into a cuboid-like shape. Subsequently, the packing film 20 is wound spirally around the lower layer 31 from the left surface 37*b* then to the front surface 38, the right surface 37*a*, and the rear surface 39 in this sequence (these four surfaces are hereinafter referred to as "side surfaces").

After the lower layer 31 is wrapped spirally with the packing film 20, the middle layer 33 is formed on the top surface of the lower layer 31 by stacking a predetermined number of the cartons 10 thereon and arranging them into a cuboid-like shape. Subsequently, the packing film 20 that has been wound around the lower layer 31 is continuously wound around the middle layer 33 spirally and evenly, thereby fixing the lower layer 31 and the middle layer 33 to each other. Thus, the lower layer 31 and the middle layer 33 are securely fixed together by the packing film 20.

After the lower layer 31 and the middle layer 33 are fixed together by the packing film 20, the upper layer 32 is formed on the top surface of the middle layer 33 by stacking a predetermined number of the cartons 10 thereon and arranging them into a cuboid-like shape. The recess-like insertion sections 34 have been provided respectively on the right and the left of the middle layer 33 during stacking of the middle layer 33 on the lower layer 31. Accordingly, during formation of the upper layer, the cartons 10 are to be stacked on the middle layer 33 in unstable condition. Accordingly, the packing film 20 is wound spirally around the cartons 10 in the lowermost part of the upper layer 32 in appropriate timing in the process of stacking the cartons 10 on the middle layer 33. The upper layer 32 is formed in this manner while the cartons 10 are prevented from collapsing.

The upper layer 32 is formed by stacking the cartons 10 in a predetermined number (this manner, while the packing film 20 is continuously wound around the upper layer 32. Thus, as illustrated in FIG. 3(*a*), the packing film 20 is wound spirally around the side surfaces of the layered body.

When the packing film 20 is wound spirally, the packing film 20 is brought into close contact with the side surfaces of the packed body 1 and an appropriate pressure is applied to the stacked cartons 10 so as to prevent the cartons 10 from collapsing.

In other words, the packing film 20 is spirally wound around the entire side surfaces of the lower layer 31, the middle layer 33, and the upper layer 32. During winding, the packing film 20 is coverably wound around the side surfaces of the packed body 1 with an appropriate tension, thereby constricting and fixing the cartons 10.

In the above description, the packing film 20 is wound around the cartons 10 successively so as to match the progress of stacking the cartons 10. However, in the case where the cartons 10 can be stacked without collapsing, all of the cartons 10 of the packed body 1 may be arranged and stacked together. After the entire packed body 1 is shaped by stacking all of the cartons 10, the packing film 20 may be wound spirally around the packed body 1 in one operation.

Next, as illustrated in FIG. 3(*b*), the packed body 1 wrapped spirally with the packing film 20 is laid sideways, and the packing film 20 is wound further around the packed body 1 in the direction indicated by the arrow. More specifically, the packing film 20 is wound around the packed body 1 from the front surface 38 then to the top surface 36, the rear surface 39, and the bottom surface 35 in this sequence so as to cover these surfaces entirely. In this step, the front sides and the rear sides of the insertion sections 34 are covered completely with the packing film 20.

Next, as illustrated in FIG. 3(*c*), the packed body 1 is raised upright from the state of the packed body 1 lying sideways, and the packing film 20 is wound in the direction indicated by the arrow. More specifically, the packing film 20 is wound around the packed body 1 from the bottom surface 35 then to the left surface 37*b*, the top surface 36, and the right surface 37*a* in this sequence so as to cover these surfaces entirely. In this step, the right side and the left side of the corresponding insertion sections 34 are covered completely with the packing film 20.

When a forklift lifts the packed body 1, the fork unit of the forklift tears the packing film 20 that covers the front sides of the insertion sections 34 and enter the insertion sections 34 before lifting the packed body 1.

Thus, when the packed body 1 is lifted or transported by using the fork unit, the packing film 20 wound around the right surface 37*a* and the left surface 37*b* serves as protection walls for the insertion sections 34. Accordingly, even if the fork unit is slid sideways during transportation, the packing film 20 functions as the wall and prevents the packed body 1 from falling off the fork unit, thereby preventing load collapse.

The packing film 20 wound in the direction of the arrow in FIG. 3(*b*) intersects the packing film 20 wound in the direction of the arrow in FIG. 3(*c*) at the top surface 36 and at the bottom surface 35 of the packed body 1. The packing film 20 is wound around the packed body 1 evenly in this manner. This reduces the likelihood of the cartons 10 or the toilet paper rolls 11 being damaged locally.

In addition, the packing film 20 is wound so as to cover the openings of the insertion sections 34 entirely in one operation. This eliminates complicated winding procedures and makes the winding operation easier, which thereby reduces the time required for the winding operation.

Note that it is preferable to wind the packing film 20 multiple times especially around the right surface 37*a* and the left surface 37*b* of the packed body 1 so as to increase the fixation strength. This makes the protection walls stronger. Even when the fork unit is slid roughly during transportation of the packed body 1, the packed body 1 does not readily fall off the fork unit. It is also preferable to wind the packing film multiple times with a tension being applied to the packing film so as to increase the fixation strength. This also applies to other embodiments described later.

Second Embodiment

Figure 4A:
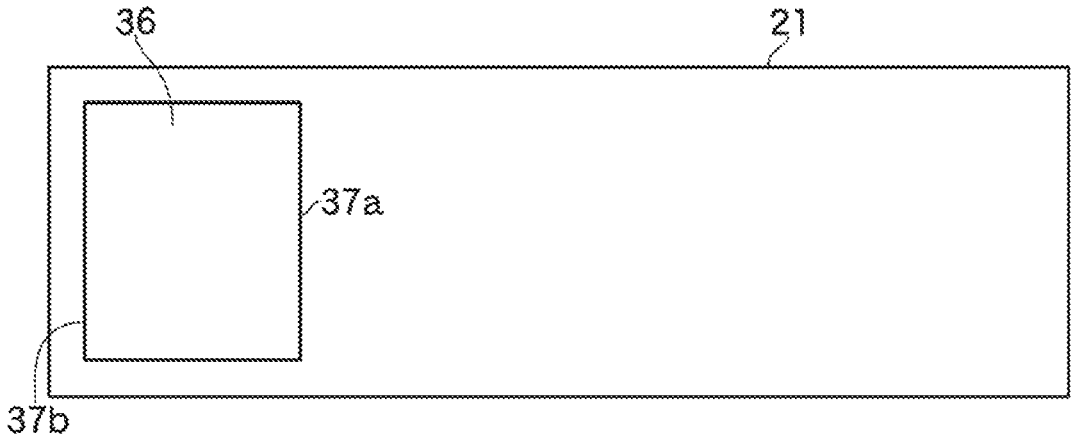
FIGS. 4(*a*), 4(*b*) are views for explanation of production method of a packed body according to a second embodiment of the present invention.
Figure 4B:
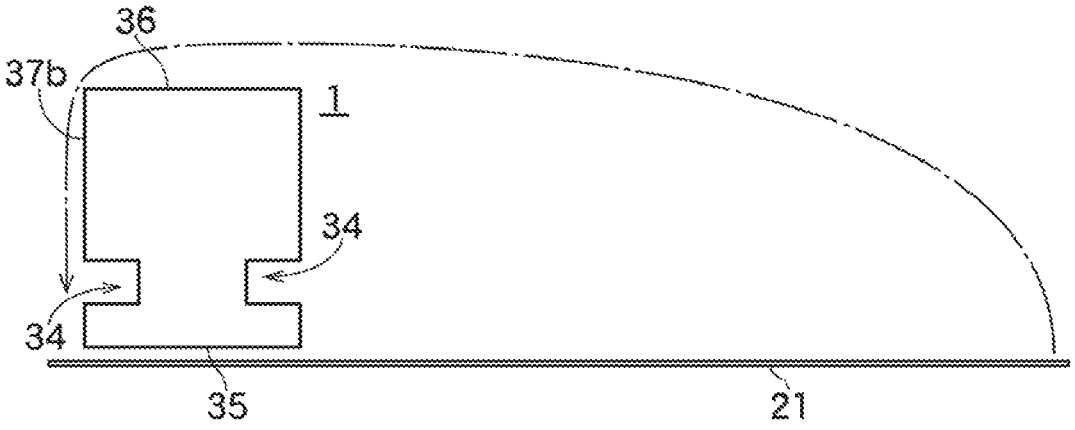

A second embodiment of the present invention will be described with reference to FIGS. 4(*a*), (*b*). FIGS. 4(*a*), (*b*) are views for explaining a production method of a packed body according to the present embodiment.

In the production method according to the present embodiment, the lower layer 31, the middle layer 33, and the upper layer 32 are stacked as illustrated in FIG. 3(*a*) in the first place. In this process, a packing film 21 having a width of several hundred millimeters is wound spirally therearound to fix the stacked layers together so as to prevent collapsing.

Note that a packing film 21 is a thin film made of the material described in the first embodiment. The width of the packing film 21 is similar to or slightly larger than the depth dimension of the packed body 1, and the length of the packing film 21 is such that the packing film 21 can cover at least the side surfaces of the packed body 1.

As illustrated in FIG. 4(*a*), the packed body 1 around which the packing film 21 is wound spirally is placed on the packing film 21 at a position near a longitudinal end thereof. Subsequently, as illustrated in FIG. 4(*b*), the other longitudinal end of the packing film 21 is brought toward the top surface 36 of the packed body 1 in the direction indicated by the arrow.

The packing film 21 is further brought so as to cover the left surface 37*b* and reach the bottom surface 35. The packing film 21 is thereby wound around the packed body 1. When the packing film 21 is wound around, the right side opening and the left side opening of the insertion sections 34 are covered with the packing film 21.

Note that it is preferable that depending on the strength of the packing film 21 and the weight of the packed body 1, the packing film 21 be wound multiple times around the packed body 1 so as to provide a fixation strength enough to prevent deformation or collapse of the packed body 1 when lifted by a forklift.

Third Embodiment

Figure 5A:
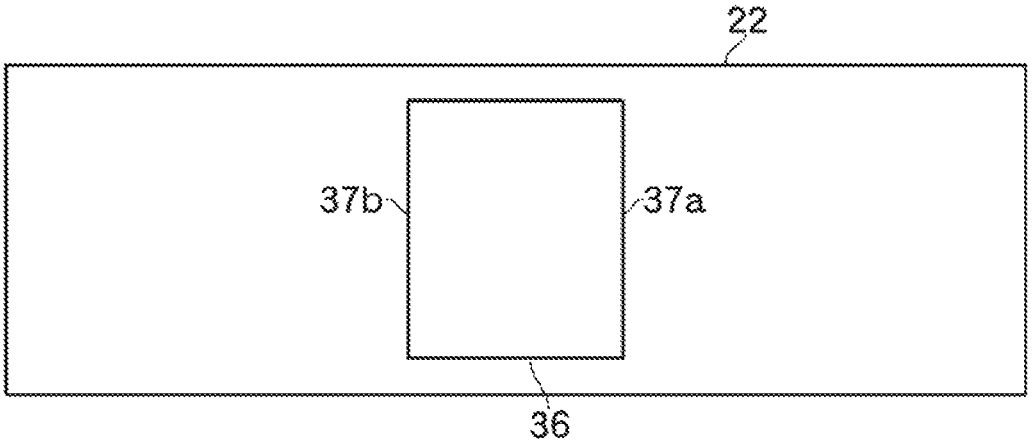
FIGS. 5(*a*), 5(*b*) are views for explanation of production method of a packed body according to a third embodiment of the present invention.
Figure 5B:
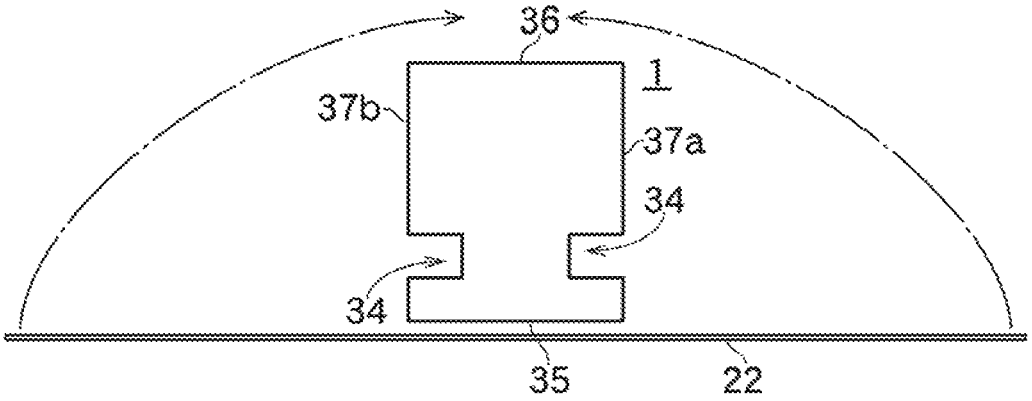

A third embodiment of the present invention will be described with reference to FIGS. 5(*a*), (*b*). FIGS. 5(*a*), (*b*) are views for explaining a production method of a packed body according to the present embodiment.

In the production method according to the present embodiment, the lower layer 31, the middle layer 33, and the upper layer 32 are stacked as illustrated in FIG. 3(*a*) in the first place. In this process, a packing film 20 having a width of several hundred millimeters is wound spirally therearound to fix the stacked layers together so as to prevent collapsing. Note that the material, width, and length of the packing film 22 are the same as those described in the second embodiment.

As illustrated in FIG. 5(*a*), the packed body 1 around which the packing film 22 is wound spirally is placed on the packing film 22 at a central region thereof. Subsequently, as illustrated in FIG. 5(*b*), both longitudinal ends of the packing film 22 are brought toward the top surface 36 of the packed body 1 in the directions indicated by the arrows.

The packing film 22 is further brought so as to cover the right surface 37*a* and the left surface 37*b* and reach the top surface 36. The packing film 22 is thereby wound around the side surfaces of the packed body 1. When the packing film 22 is wound around, the right side opening and the left side opening of the insertion sections 34 are covered with the packing film 22.

Note that it is preferable that depending on the strength of the packing film 22 and the weight of the packed body 1, the packing film 22 be wound multiple times around the packed body 1 so as to provide a fixation strength enough to prevent deformation or collapse of the packed body 1 when lifted by a forklift.

Fourth Embodiment

Figure 6A:
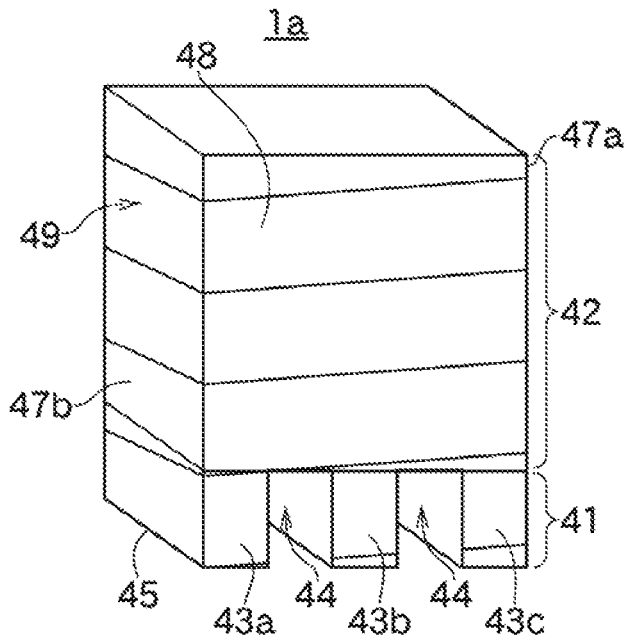
FIGS. 6(*a*), 6(*b*) are views for explanation of production method of a packed body according to a fourth embodiment of the present invention.
Figure 6B:
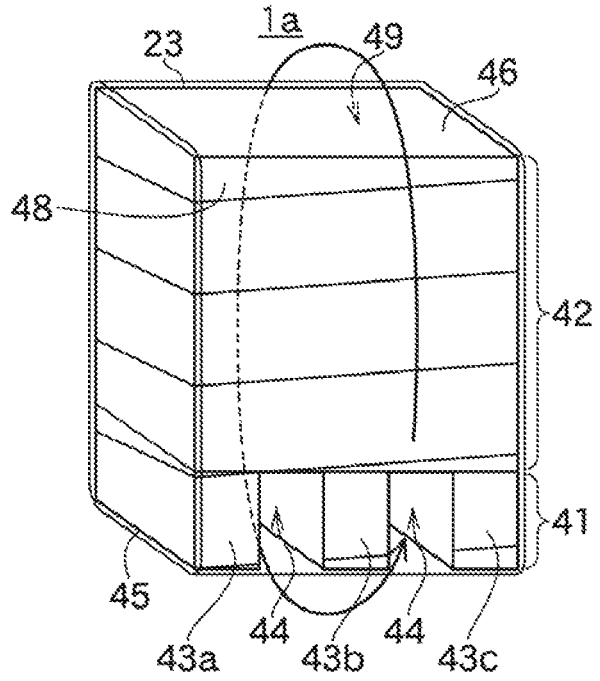

Next, a fourth embodiment of the present invention will be described with reference to FIGS. 6(*a*), (*b*). FIG. 6(*a*) is a diagram illustrating a state in which a layered body according to the present embodiment is wrapped spirally. FIG. 6(*b*) is a diagram illustrating a state in which the layered body according to the present embodiment is wrapped in the up-down direction.

Similarly to the upper layer 32 of the packed body 1 described in the first embodiment, an upper layer 42 is formed by arranging a predetermined number of cartons 10 horizontally and by stacking the cartons 10. The upper layer 42 is formed into a cuboid-like shape. On the other hand, a lower layer 41 includes multiple leg portions 43*a* to 43*c* each of which is formed by arranging a predetermined number of cartons 10. Insertion sections 44, in other words, recesses of the packed body 1*a* are formed between adjacent leg portions.

The insertion sections 44 are provided in at least the lower layer 41 at two positions equidistantly and formed into such a shape and size that the fork unit of a forklift can be inserted and can stay therein. The insertion sections 44 are recesses that open downward at the lower layer 41 and extend downward along a right surface 47*a* and a left surface 47*b*. The insertion sections 44 also open at a front surface 48 and a rear surface 49 of a packed body 1*a*.

Namely, the leg portions 43*a* to 43*c* are protrusions that protrude downward from an upper layer 42. In a lower region of the packed body 1*a*, the leg portions 43*a* to 43*c* extend between the front surface 48 and the rear surface 49, in other words, in the front-rear direction of the packed body 1*a*.

In the packed body 1*a* according to the present embodiment, the leg portion 43*a* is formed so as to be flush with the left surface 47*b*, and the leg portion 43*c* is formed so as to be flush with the right surface 47*a*. In other words, the leg portions 43*a* to 43*c* are formed equidistantly in such a manner that the leg portion 43*a* is disposed at a side end of the upper layer 42, the leg portion 43*c* is disposed at another side end of the upper layer 42, and the leg portion 43*b* is disposed in the middle between the leg portion 43*a* and the leg portion 43*c*.

Accordingly, the packed body 1*a* is shaped such that the cuboid-like upper layer 42 is supported from below by the three leg portions 43*a* to 43*c*. The shape of the packed body 1*a* is maintained, for example, by winding a packing film 23, which has the width described in the first embodiment, around the cartons 10 as described later and thereby fixing the cartons 10 and thereby the leg portions 43*a* to 43*c* are disposed equidistantly.

In production of the packed body 1*a*, the lower layer 41 and the upper layer 42 are formed by arranging and stacking a predetermined number of the cartons 10, and the packing film 23 is subsequently wound therearound as illustrated in FIG. 6(*a*). In other words, the packing film 23 is wound spirally around the packed body 1*a* from a lower part to an upper part thereof without leaving gaps therebetween, thereby wrapping the side surfaces of the packed body 1*a*.

It may be difficult to stack the cartons 10 that constitute the upper layer 42 on the top surfaces of the cartons 10 that constitute the leg portions 43*a* to 43*c* of the lower layer 41. In such a case, the upper layer 42 may be formed first by stacking and arranging a predetermined number of the cartons 10, and the upper layer 42 may be wrapped spirally with the packing film 23. The upper layer 42 wrapped with the packing film 23 may be subsequently placed on the top surfaces of the leg portions 43*a* to 43*c*, thereby forming the packed body 1*a*.

Next, as illustrated in FIG. 6(*b*), the packing film 23 is wound in the direction indicated by the arrow around the upper layer 42 and the leg portions 43*a* to 43*c* disposed on the bottom surface of the upper layer 42, which thereby fixes the upper layer 42 to the leg portions 43*a* to 43*c*.

More specifically, the packing film 23 is wound around the packed body 1*a* in the arrow direction from a bottom surface 45 then to the rear surface 49, a top surface 46, and the front surface 48 in this sequence so as to cover these surfaces entirely and to cover the openings of the insertion sections 44 entirely.

In this process, the packing film 23 is wound around the front surface 48, the rear surface 49, the top surface 46, and the bottom surface 45 of the upper layer 42 and the lower layer 41, which thereby fixes the leg portions 43*a* to 43*c* to the bottom surface of the upper layer 42. When the packing film 23 is wound in this way, it is preferable that depending on the strength of the packing film 23 and the weight of the packed body 1*a* and the like, the packing film 23 be wound multiple times around the packed body 1*a* so as to provide a fixation strength enough to prevent deformation or collapse of the packed body 1*a* when lifted by a forklift.

When a forklift lifts the packed body 1*a*, the fork unit of the forklift tears the packing film 23 that covers the front sides of the insertion section 44 and enters the insertion sections 44 before lifting the packed body 1*a*.

REFERENCE SIGNS LIST

1, 1*a* packed body
10 carton
11 toilet paper roll (paper material)
20 to 23 packing film
31, 41 lower layer
32, 42 upper layer
33 middle layer
34, 44 insertion section
35, 45 bottom surface
36, 46 top surface
37*a*, 47*a* right surface
37*b*, 47*b* left surface
38, 48 front surface
39, 49 rear surface
43*a*, 43*b*, 43*c* leg portion

The invention claimed is:

1. A packed body production method for producing a packed body by packing a layered body of cartons containing paper material, the packed body production method comprising:

a first step in which the layered body is formed by winding a packing film spirally around the cartons containing paper material so as to match progress of stacking the cartons and insertion sections into which a fork unit of a forklift is inserted is formed at a predetermined position in the layered body;

a second step in which after the layered body is laid sideways, the packing film is wound around a front surface, a rear surface, a top surface, and a bottom surface of the layered body so as to retain the layered body entirely and close a front opening and a rear opening of the insertion section; and a third step in which after the second step is carried out, the layered body is returned to its original state before the layered body being laid sideways, and a side opening of each of the insertion section is closed by winding the packing film around the top surface, the bottom surface, a right surface, and a left surface of the layered body, wherein in the first step, the cartons are stacked in such a manner that the insertion sections are formed at such a position as to enable the layered body to be lifted using the fork unit of the forklift, and in the third step, the packing film is wound around the layered body so as to generate such a fixation strength that the layered body does not collapse when the layered body is lifted using the fork unit of the forklift.

2. The packed body production method according to claim 1, wherein in the first step, the layered body includes a lower layer, an intermediate layer disposed on the lower layer, and an upper layer disposed on the intermediate layer, and the insertion sections are formed as recesses at opposite side surfaces of the layered body by disposing the intermediate layer having a width smaller than a width of the lower layer and a width of the upper layer.

* * * * *